US008739537B2

(12) United States Patent
Tsuboi et al.

(10) Patent No.: US 8,739,537 B2
(45) Date of Patent: Jun. 3, 2014

(54) POWER GENERATION APPARATUS

(75) Inventors: Noboru Tsuboi, Kako-gun (JP); Masayoshi Matsumura, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 8 days.

(21) Appl. No.: 13/486,461

(22) Filed: Jun. 1, 2012

(65) Prior Publication Data

US 2013/0000304 A1 Jan. 3, 2013

(30) Foreign Application Priority Data

Jun. 30, 2011 (JP) ..... 2011-146405

(51) Int. Cl.
*F01K 13/02* (2006.01)
*F01D 17/08* (2006.01)

(52) U.S. Cl.
USPC ..... 60/660; 60/665

(58) Field of Classification Search
CPC ..... F01D 17/08; F01K 13/02
USPC ..... 60/643–684
See application file for complete search history.

(56) References Cited

U.S. PATENT DOCUMENTS

| | | | | |
|---|---|---|---|---|
| 4,403,476 | A * | 9/1983 | Johnson et al. | 60/652 |
| 4,593,527 | A * | 6/1986 | Nakamoto et al. | 60/660 |
| 6,234,400 | B1 | 5/2001 | Guyer | |
| 6,981,377 | B2 * | 1/2006 | Vaynberg et al. | 60/641.8 |
| 7,200,996 | B2 * | 4/2007 | Cogswell et al. | 60/651 |
| 8,186,161 | B2 * | 5/2012 | Ast et al. | 60/660 |
| 2003/0213245 | A1 * | 11/2003 | Yates et al. | 60/651 |
| 2004/0255591 | A1 | 12/2004 | Hisanaga et al. | |
| 2009/0071156 | A1 * | 3/2009 | Nishikawa et al. | 60/660 |
| 2010/0018207 | A1 * | 1/2010 | Juchymenko | 60/670 |
| 2010/0090476 | A1 * | 4/2010 | Wada | 290/1 A |

FOREIGN PATENT DOCUMENTS

| | | | |
|---|---|---|---|
| DE | 2 105 692 | | 8/1972 |
| DE | 102 21 594 | A1 | 11/2003 |
| DE | 10221594 | B4 * | 2/2006 |

(Continued)

OTHER PUBLICATIONS

Naoyuki Inoue, et al. "Development of a Power Generation Unit Driven by Waste Heat (Study on Working Fluids and Expansion Turbines)", Ebara Engineering Review No. 211, Apr. 2006, 10 pages.

(Continued)

*Primary Examiner* — Thomas Denion
*Assistant Examiner* — Laert Dounis
(74) *Attorney, Agent, or Firm* — Oblon, Spivak, McClelland, Maier & Neustadt, L.L.P.

(57) ABSTRACT

In a power generation apparatus, a working medium is evaporated in an evaporator using a heating medium supplied from outside, and the evaporated working medium is subsequently introduced into an expander, which is connected to an electric generator, to convert a thermal expansion force of the working medium into a rotation force inside the expander for generation of electric power. Then, the working medium exhausted from the expander is fed into a condenser in which the working medium is condensed by cooling the working medium with a coolant medium supplied from outside, and the condensed working medium is pressurized by a circulating pump to resupply the evaporator with the pressurized working medium. In the power generation apparatus, when a condensing pressure in the condenser is high, a rotational speed of the circulating pump and a suction volume of the evaporator are increased.

4 Claims, 3 Drawing Sheets

(56) References Cited

FOREIGN PATENT DOCUMENTS

| | | | |
|---|---|---|---|
| JP | 60-144594 | | 7/1985 |
| JP | 09-273818 | A | 10/1997 |
| JP | 11-248106 | A | 9/1999 |
| JP | 2006-057597 | A | 3/2006 |
| WO | WO 2008/031716 | A2 | 3/2008 |

OTHER PUBLICATIONS

U.S. Appl. No. 13/471,830, filed May 15, 2012, Tsuboi, et al.
Extended European Search Report issued Oct. 26, 2012 in Patent Application No. 12171578.3.
Office Action issued Jun. 25, 2013 in Korean Patent Application No. 10-2012-70392 (with English language translation).

* cited by examiner

POWER GENERATION APPARATUS

BACKGROUND OF THE INVENTION

1. Field of the Invention

The present invention relates to a power generation apparatus based on a Rankine cycle employed in a binary power generator and the like.

2. Description of the Related Art

In terms of energy conservation, recent years have seen an increased need for electric power generators that collect so-called "waste heat" from various types of facilities such as factories and generate electricity using the energy from the collected waste heat. Because the "waste heat" does not have, in many cases, a sufficiently high temperature to allow generation of water vapor that drives steam turbines used for general electric power generators, there has been a demand for electric power generators capable of generating electric power by means of low temperature heat.

As such an electric power generator, a binary power generator constituting a Rankine cycle heat engine has been known, for example, as described in JP S60-144594 and described by Naoyuki INOUE and five others in "Development of a Power Generation Unit Driven by Waste Heat (Study on Working Fluids and Expansion Turbines)", Ebara Engineering Review No. 211, p. 11-20, April 2006, EBARA CORPORATION. The binary power generator comprises an evaporator for evaporating a low boiling point working medium, an expander such as a turbine for causing expansion work of the working medium vapor to drive an electric generator, a condenser for condensing the working medium vapor, and a circulating pump for pressurizing the working medium to resupply the evaporator with the pressurized working medium, which are connected in series to form a closed loop for circulating the working medium.

In the Rankine cycle heat engine, an amount of energy that can be extracted by the expander matches, in theory, is a difference between an enthalpy of the working medium at an outlet of the evaporator and an enthalpy of the working medium at an inlet of the condenser. In an ideal condition, the working medium is caused in the expander to undergo isentropic change through which the pressure of the working medium is reduced to a condensing pressure in the condenser.

For a cold source for cooling the working medium in the condenser, an inexpensive medium such as coolant water produced through a cooling tower is typically used. This causes a condensing temperature in the condenser, i.e. the condensing pressure of the working medium to vary with the seasons. That is, in conventional power generation apparatuses, the temperature of the coolant water becomes higher in summer, which in turn increases the temperature and pressure, i.e. the enthalpy of the working medium at the inlet of the condenser. Thus, there has been a problem in that, due to the increased enthalpy, an amount of energy that can be extracted by the expander (i.e. a power generation capacity in a case where the expander is used for driving the electric generator) is decreased.

SUMMARY OF THE INVENTION

In view of the aforesaid current problem, the present invention advantageously provides a power generation apparatus in which generated energy is not decreased even when the temperature of coolant water becomes higher.

To achieve this, the power generation apparatus according to the present invention comprises an evaporator that causes a liquid working medium to be evaporated by application of heat from a thermal medium, an expander that expands a gas of the working medium to generate electric power, the expander which is a positive displacement expander, a condenser that causes the working medium to be condensed by cooling the gas of the working medium with a coolant medium, a circulating pump that circulates the working medium, a closed-loop circulating channel in which the evaporator, the expander, the condenser, and the circulating pump are connected in series, a condensing pressure detector that detects a condensing pressure in the condenser, and a controller that controls a rotational speed of the circulating pump and a suction volume of the expander, both of which are to be increased when the condensing pressure detected by the condensing pressure detector is high.

According to the above-described configuration, in view of a fact that when the condensing pressure in the condenser is high, energy per unit flow of the working medium that can be extracted by the expander is decreased, a flow rate of the working medium may be increased to thereby compensate for a decrease of generated energy.

Further, in the power generation apparatus of the present invention, the controller may continuously change the rotational speed of the circulating pump in accordance with the condensing pressure. Still further, the controller may continuously change the suction volume of the expander in accordance with the condensing pressure.

According to the above-described configuration, because the flow rate of the working medium can be appropriately increased depending on to what extent the condensing pressure in the condenser is high or low, the effect of compensating for the decrease of generated energy in a more flexible and adequate manner can be obtained.

Moreover, in the power generation apparatus of the present invention, a channel for connecting the evaporator and the expander may be connected to an internal space of the expander located in midstream of expansion therein, to thereby increase the suction volume of the expander.

According to the above configuration, the suction volume can be adjusted with a simple configuration.

As has been described above, it becomes possible according to the present invention to provide the power generation apparatus in which generated energy is not decreased even when a temperature of coolant water is raised.

DESCRIPTION OF THE PREFERRED EMBODIMENTS

Figure 1:
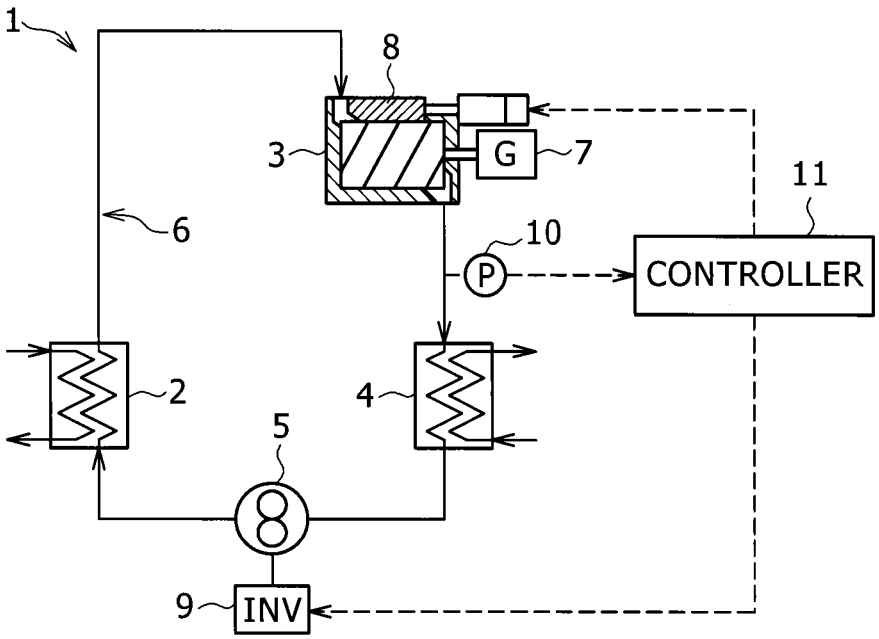
FIG. 1 is a configuration diagram showing a binary power generator according to a first embodiment of this invention.

Hereinafter, embodiments of the present invention will be described with reference to the drawings. FIG. 1 shows a configuration of a binary power generator 1 implemented as a first embodiment of a power generation apparatus according to the present invention. The binary power generator 1 includes a circulating channel 6 incorporating an evaporator 2, a screw expander 3, a condenser 4, and a circulating pump 5, and filled with a working medium (such as, for example, R245fa).

The evaporator 2 is a heat exchanger that heats up the working medium with hot water or the like exhausted from a facility such as a factory to evaporate the working medium. The evaporator 2 causes the working medium to evaporate at a predetermined pressure (of 0.786 MPa, for example), and further heats up a vapor of the working medium to, for example, 90° C. (super heat degree of 10° C.).

The screw expander 3 including a pair of male and female screw rotors housed in a rotor chamber, which is formed inside a casing, is a positive displacement expander that expands the working medium in an internal space formed in the rotor chamber divided by the screw rotors, to thereby rotate the screw rotors. A screw rotor shaft projected outside the casing of the screw expander 3 is connected to an electric generator 7.

In addition, the screw expander 3 further includes a slide valve 8 for adjusting a size of an air supplying port in order to regulate a suction volume, which is a volume of the internal space obtained at a time when an expansion process for the working medium is substantially started (at the moment of separation from the circulating channel 6).

The condenser 4 is a heat exchanger in which the working medium is liquefied through cooling by an inexpensive cold source such as coolant water produced in a cooling tower. A pressure on an upstream side of the condenser 4 is a condensing pressure determined by a condensing temperature of the working medium in the condenser 4.

The circulating pump 5 pressurizes the working medium having been liquefied in the condenser 4 to resupply the evaporator 2 with the pressurized working medium. The circulating pump 5 is a positive displacement pump, such as, for example, a rotary pump, for delivering the working medium whose amount is proportional to the rotational speed of the pump. The rotational speed of the circulating pump 5 is controlled by an inverter 9.

Moreover, the binary power generator 1 comprises a condensing pressure detector 10 for detecting a pressure of the circulating channel at a location between the screw expander 3 and the condenser 4, i.e. the condensing pressure in the condenser 4, and further includes a controller 11 for controlling the slide valve 8 and the inverter 9 based on a detection value detected by the condensing pressure detector 10. In other words, the controller 11 controls the suction volume of the screw expander 3 and the rotational speed of the circulating pump 5.

Figure 2:
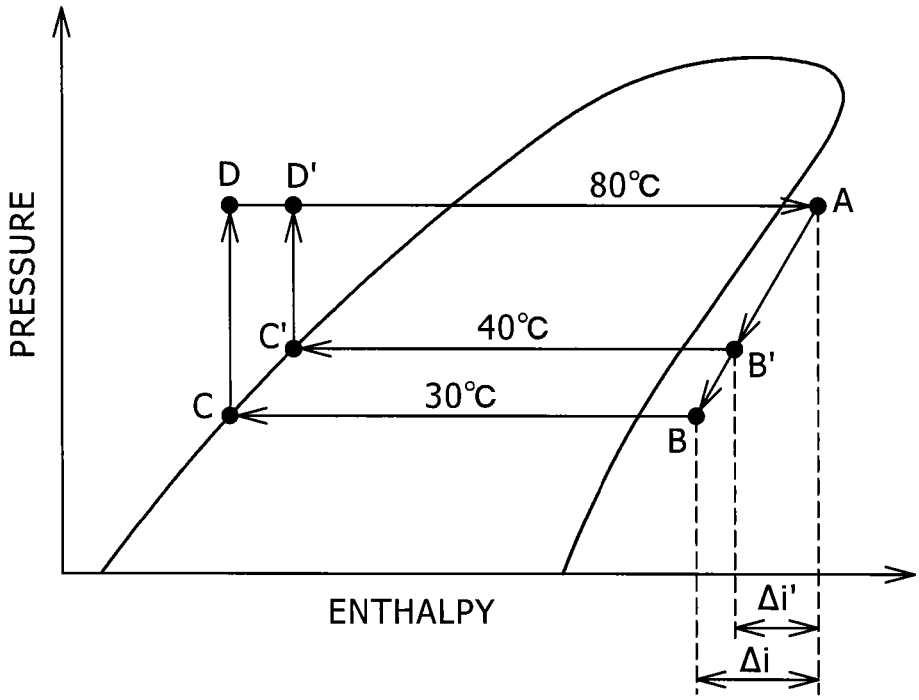
FIG. 2 is a Mollier diagram showing changes in state of a working medium in binary power generation of FIG. 1.

FIG. 2 shows a Mollier diagram (P-i diagram) on which changes in state of the working medium in the binary power generator 1 are plotted. A point A represents a state of the working medium (having a pressure of 0.786 MPa and 90° C.) supplied to the screw expander 3.

A point B represents a state of the working medium exhausted from the screw expander 3 in a case where the condensing temperature in the condenser 4 is 30° C. The pressure at the point B is the condensing pressure (PL=0.179 MPa) determined by the condensing temperature in the condenser 4, while a change in state of from the point A to the point B is an isentropic change. This means that a location of the point B is uniquely determined from a location of the point A and the condensing temperature in the condenser 4.

A point C showing a state of the working medium discharged from the condenser 4 is a point on a saturation liquid line at the condensing temperature. A point D shows a state of the working medium at an inlet of the evaporator 2, in which a pressure of the working medium is increased by the circulating pump 5 from the state at the point C to an evaporating pressure determined by an evaporating temperature of the working medium in the evaporator 2. The evaporator 2 heats up the working medium from the state at the point D to the state at the point A.

Further, in FIG. 2, a change in state of the working medium when the condensing temperature in the condenser 4 is 40° C. is also shown. This value of 40° C. is a value of the condensing temperature assumed to be increased as a temperature of coolant water is raised in summer. A point B' representing a state at an outlet of the screw expander 3 is a point obtained by the isentropic change to the condensing pressure (PH=0.252 MPa) from the point A when the condensing temperature is 40° C. Both a point C' representing the state at an outlet of the condenser 4 and a point D' representing the state at the inlet of the evaporator 2 are also shifted by an increase in condensing pressure.

In this diagram, electric power obtained when the screw expander 3 converts 100% of an expansion force of the working medium per unit amount and an efficiency of the electric generator is 100% corresponds to a difference (Δi or Δi') between a specific enthalpy at the point A and a specific enthalpy at the point B or B'. Thus, ideally, a power generation capacity of the binary power generator 1 matches a value obtained by multiplying the difference (Δi or Δi') between the specific enthalpies by a circulating flow rate of the working medium.

Figure 3:
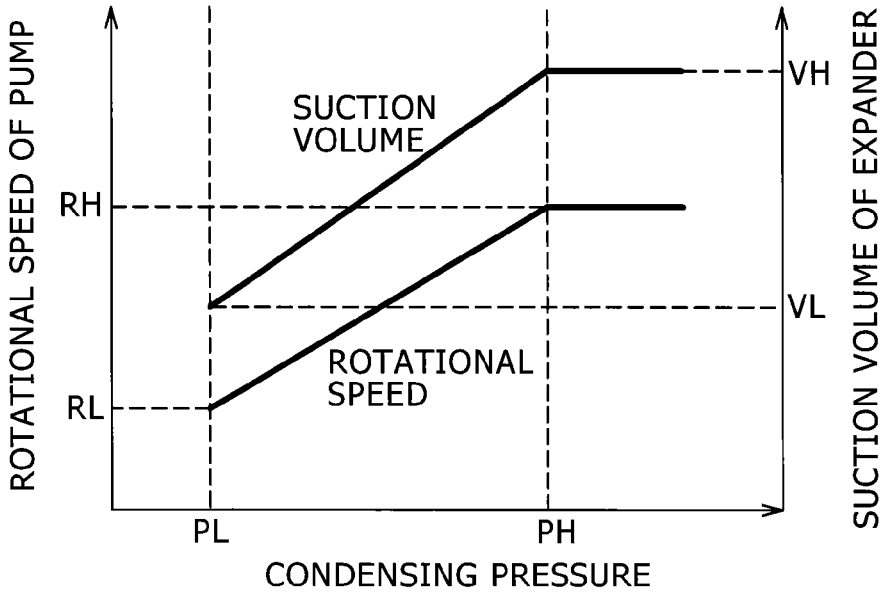
FIG. 3 is a diagram showing relationships between a condensing pressure and a rotational speed of a circulating pump and between the condensing pressure and a suction volume of an expander in binary power generation of FIG. 1.

The controller 11 regulates, as shown in FIG. 3, the suction volume of the screw expander 3 and the rotational speed of the circulating pump 5 in proportion to the condensing pressure in the condenser 4 detected by the condensing pressure detector 10. More specifically, when the condensing pressure in the condenser 4 is higher (for example, when the condensing pressure has a value of PH that is higher than a value of PL), the controller 11 increases the rotational speed of the circulating pump 5 (for example, increases the rotational speed of the circulating pump 5 to a speed of RH higher than that that of RL). Also, when the condensing pressure in the condenser 4 is higher (for example, when the condensing pressure has the value of PH that is higher than the value of PL), the controller 11 increases the suction volume of the expander 3 (for example, increases the suction volume of the expander 3 to a volume of VH greater than that of VL).

It should be noted that the controller 11 adjusts the slide valve 8 and the inverter 9 in such a manner that when the value detected by the condensing pressure detector 10 reaches the condensing pressure (PH=0.252 MPa) obtained at the condensing temperature of 40° C., the suction volume of the screw expander 3 arrives at a mechanical upper limit (VH) and the rotational speed of the circulating pump 5 arrives at a mechanical upper limit (RH).

When the rotational speed of the circulating pump 5 is increased, a delivery rate of the working medium delivered from the circulating pump 5 is accordingly increased. However, in order to increase the circulating flow rate of the working medium flowing through the circulating channel 6, the suction volume of the screw expander 3 on a working medium receiving side should be increased as a function of the increase in the working medium delivered from the circulating pump 5. Namely, in addition to increasing the rotational speed of the circulating pump 5 in accordance with an increased condensing pressure, the suction volume of the screw expander 3 is also increased, which can lead to a smooth increase in the circulating flow rate of the working medium flowing through the circulating channel 6.

Then, although energy per unit amount of the working medium that the screw expander 3 is able to convert into power will be decreased as the condensing pressure is increased, a total amount of the energy that the screw expander 3 is able to convert into power can be maintained by increasing the flow rate of the working medium circulating through the circulating channel 6 as a function of the increase in the condensing pressure. Specifically, there has conventionally been a problem that the temperature and pressure of the working medium, i.e. the enthalpy at the inlet of the condenser 4 is increased in summer due to a raised temperature of coolant water, which results in reduction of energy extractable by means of the screw expander 3, i.e. a decrease of the power generation capacity. However, the conventional problem can be addressed by the binary power generator 1 according to the present invention, in which the decrease of the power generation capacity can be compensated by increasing the flow rate of the working medium.

Note that because the controller 11 continuously changes the rotational speed of the circulating pump 5 in accordance with the condensing pressure while continuously changing the suction volume of the screw expander 3, it is possible to appropriately increase the flow rate of the working medium depending on to what extent the condensing pressure in the condenser 4 is higher or lower. In other words, assuming that the condensing pressure is a pressure PM (not illustrated) lying between the values of PL and PH, the controller 11 is able to set the rotational speed of the circulating pump 5 and the suction volume of the screw expander 3 corresponding to the condensing pressure PM, which can provide the effect of compensating for the decrease of the power generation capacity in a more flexible and more appropriate way (than that achieved by setting the rotational speed of the circulating pump 5 and the suction volume of the screw expander 3 in a stepwise manner).

Further, by increasing both the suction volume of the screw expander 3 and the rotational speed of the circulating pump 5 as the condensing pressure is increased, the flow rate of the working medium can be increased without causing an extreme increase in the rotational speed of the screw expander 3. In this way, the extreme increase in the rotational speed of the screw expander 3 is prevented, which can in turn eliminate a risk that the rotational speed of the screw expander 3 reaches its upper limit defined by specifications (the maximum rotational speed specified to avoid a service life of bearings from being shortened or avoid vibrations from occurring).

Figure 4:
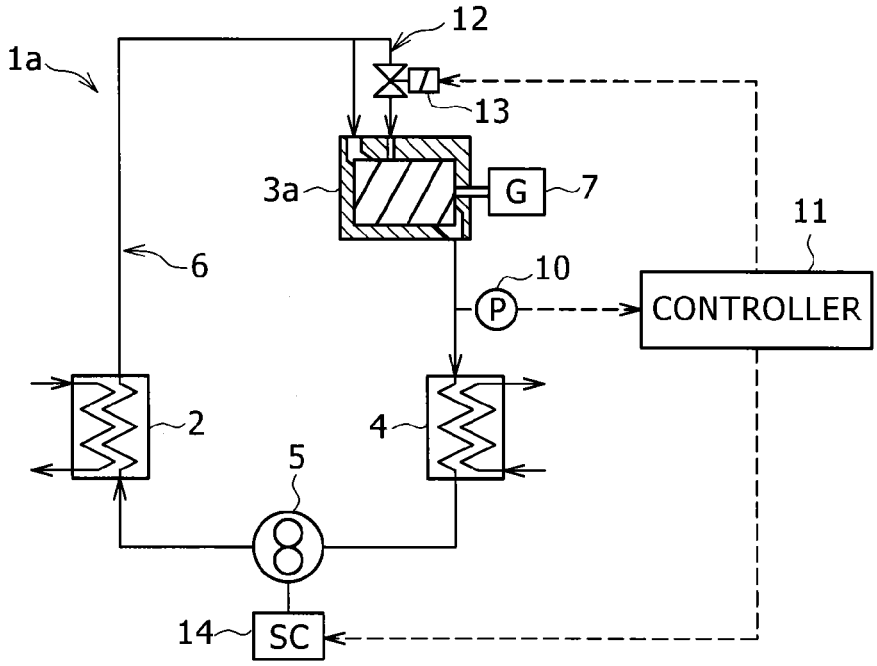
FIG. 4 is a configuration diagram showing the binary power generator according to a second embodiment of this invention.

Next, in FIG. 4, a binary power generator 1*a* is illustrated as a second embodiment of the power generation apparatus according to the present invention. Note that, in this embodiment, the same components as those of the first embodiment are designated by the same reference numerals as those of the first embodiment, and the descriptions related to the components will not be repeated.

A screw expander 3*a* of this embodiment is not able to continuously change the suction volume, but designed to allow setting of two different suction volumes. Specifically, in the screw expander 3*a* including an auxiliary channel 12, which is branched from the circulating channel 6 and communicated with the internal space located in midstream of expansion in the screw expander 3*a*, the suction volume is substantially increased by releasing an auxiliary supply valve 13 inserted in the auxiliary channel 12.

Further, the circulating pump 5 of this embodiment includes a speed changing device 14 to allow setting of two rotational speeds. The speed changing device 14 may be, for example, a mechanical device such as a gearbox or an electrical device such as a unit for changing the number of poles in the electric generator.

Figure 5:
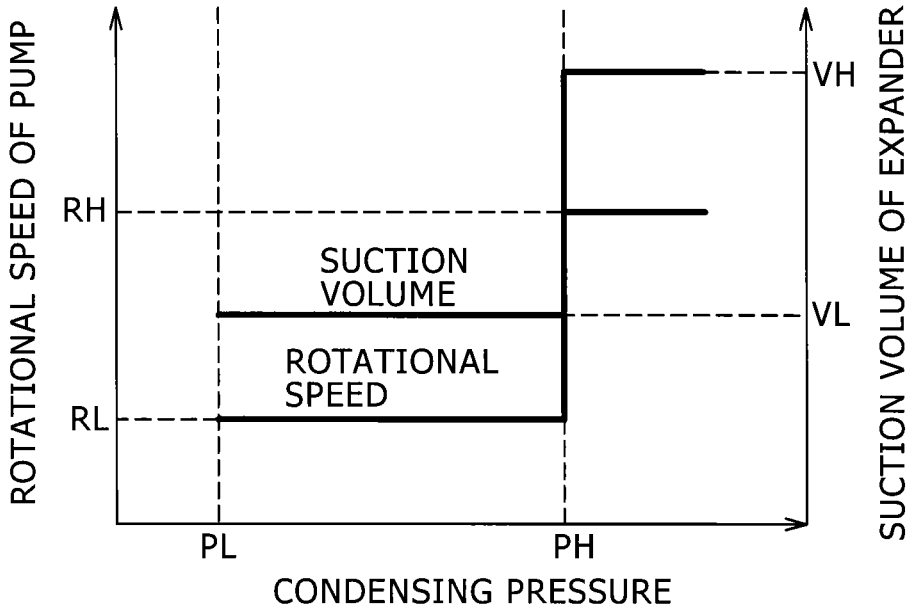
FIG. 5 is a diagram showing relationships between a condensing pressure and a rotational speed of the circulating pump and between the condensing pressure and a suction volume of the expander in binary power generation of FIG. 4.

In the binary power generator 1*a* according to this embodiment, as shown in FIG. 5, when the value detected by the condensing pressure detector 10 reaches the condensing pressure (PH=0.252 MPa) associated with the condensing temperature of 40° C., the suction volume of the screw expander 3*a* is set to a greater value while the rotational speed of the circulating pump 5 is set to a higher speed.

As achieved in this embodiment, only in a relatively simple configuration for making the suction volume of the screw expander 3*a* and the rotational speed of the circulating pump 5 adjustable in two stages, the decrease in power generation capacity resulting from an increased condensing temperature in the condenser 4 can be compensated to a certain extent.

Still further, according to the present invention, the suction volume of the screw expander 3, 3*a* may be fixedly specified. Moreover, in this invention, either one of the suction volume of the screw expander 3, 3*a* or the rotational speed of the circulating pump 5 may be continuously controlled, while the other of the suction volume or the rotational speed may be controlled in a stepwise way. In addition, the condensing pressure at which the suction volume of the screw expander 3, 3*a* reaches the upper limit may be different from the condensing pressure at which the rotational speed of the circulating pump 5 reaches the upper limit.

Furthermore, an object to be driven by the power generation apparatus of this invention is not limited to the electric generator.

What is claimed is:

1. A power generation apparatus comprising:

an evaporator that causes a liquid working medium to be evaporated by application of heat from a thermal medium;

an expander that expands a gas of the working medium to produce power in said expander, said expander being a positive displacement expander;

a condenser that causes the working medium to be condensed by cooling the gas of the working medium with a coolant medium;

a positive displacement circulating pump that circulates the working medium;

a closed-loop circulating channel in which said evaporator, said expander, said condenser, and said circulating pump are connected in series;

a condensing pressure detector that detects a condensing pressure in said condenser, and a controller that controls a rotational speed of said circulating pump and a suction volume of said expander, wherein the controller comprises means for increasing the rotational speed of said circulating pump and the suction volume of said expander as the condensing pressure detected by said condensing pressure detector increases.

2. The power generation apparatus according to claim 1, wherein said controller continuously changes the rotational speed of said circulating pump in accordance with the condensing pressure.

3. The power generation apparatus according to claim 1, wherein said controller continuously changes the suction volume of said expander in accordance with the condensing pressure.

4. The power generation apparatus according to claim 1, wherein a channel for connecting said evaporator and said expander is connected to an internal space of said expander located in midstream of expansion therein, to thereby increase the suction volume of said expander.

* * * * *